US005974288A

United States Patent [19]

Sato

[11] Patent Number: 5,974,288

[45] Date of Patent: Oct. 26, 1999

[54] ELECTROPHOTOGRAPHIC IMAGE FORMING APPARATUS

[75] Inventor: Minoru Sato, Toride, Japan

[73] Assignee: Canon Kabushiki Kaisha, Tokyo, Japan

[21] Appl. No.: 09/176,338

[22] Filed: Oct. 22, 1998

[30] Foreign Application Priority Data

Oct. 23, 1997 [JP] Japan ..... 9-309781

[51] Int. Cl.[6] ..... G03G 15/08

[52] U.S. Cl. ..... 399/119; 399/120; 399/262; 222/DIG. 1

[58] Field of Search ..... 399/119, 120, 399/262; 222/DIG. 1, 153.06, 153.07

[56] References Cited

U.S. PATENT DOCUMENTS

| | | | |
|---|---|---|---|
| 5,142,335 | 8/1992 | Sakata et al. | 399/106 |
| 5,153,650 | 10/1992 | Maeshima | 399/106 |
| 5,229,824 | 7/1993 | Tsusaka et al. | 399/262 |
| 5,412,364 | 5/1995 | Iguchi et al. | 399/262 |
| 5,434,656 | 7/1995 | Nagaoka et al. | 399/106 |
| 5,594,535 | 1/1997 | Beufort et al. | 399/262 |
| 5,629,759 | 5/1997 | Jyoroku | 399/262 |
| 5,666,586 | 9/1997 | Nishimura et al. | 399/13 |
| 5,689,773 | 11/1997 | Ha | 399/106 |
| 5,781,831 | 7/1998 | Matsuzaki et al. | 399/119 |

*Primary Examiner*—Richard Moses
*Attorney, Agent, or Firm*—Fitzpatrick, Cella, Harper & Scinto

[57] ABSTRACT

A process cartridge includes a toner frame and a developing frame joined together without damaging seal members and so that toner leakage due to damage of the seal members can be prevented. The invention also relates to an electrophotographic image forming apparatus to which such a process cartridge can detachably be mounted. Inner corners of opposed portions of ridges and grooves, provided on joint surfaces of the developing frame and the toner frame where a seal member for sealing an opening formed by fitting the ridges and the grooves together, are provided with parallel inclined surfaces.

16 Claims, 9 Drawing Sheets

ELECTROPHOTOGRAPHIC IMAGE FORMING APPARATUS

BACKGROUND OF THE INVENTION

1. Field of the Invention

The present invention relates to a process cartridge which can detachably be mounted to a main body of an electrophotographic image forming apparatus, and an electrophotographic image forming apparatus to which a process cartridge can detachably be mounted.

The electrophotographic image forming apparatus serves to form an image on a recording medium by using an electrophotographic image forming process. The electrophotographic image forming apparatus may include, for example, an electrophotographic copying machine, an electrophotographic printer (for example, a laser beam printer, an LED printer and the like), an electrophotographic facsimile, an electrophotographic word processor and the like.

2. Related Background Art

In the past, in electrophotographic image forming apparatuses using an electrophotographic image forming process, an electrophotographic photosensitive drum and process means acting on the photosensitive drum have been integrally incorporated into a cartridge unit to form a process cartridge which can detachably be mounted to a main body of the electrophotographic image forming apparatus. According to this system, since the maintenance of the apparatus can be performed by an operator himself, operability is greatly improved. Thus, such a process cartridge has been widely used with the electrophotographic image forming apparatus.

In such a process cartridge, a toner frame containing toner is integrally joined to a developing frame supporting a developing means at an interface. A sealing member sealing an opening portion of the toner frame is pulled out between the toner frame and the developing frame. As a result, the toner can be sent to the developing frame. Further, after the sealing member is pulled out, in order to prevent the toner from leaking through the interface, a seal member is provided between the toner frame and the developing frame.

The present invention relates to an improvement in the prior art.

SUMMARY OF THE INVENTION

An object of the present invention is to provide a process cartridge and an electrophotographic image forming apparatus to which such a process cartridge can detachably be mounted, in which a toner frame and a developing frame can surely be joined together.

Another object of the present invention is to provide a process cartridge and an electrophotographic image forming apparatus to which such a process cartridge can detachably be mounted, in which toner can be prevented from leaking between a toner frame and a developing frame.

A further object of the present invention is to provide a process cartridge and an electrophotographic image forming apparatus to which such a process cartridge can detachably be mounted, in which a toner frame and a developing frame can be joined together without damaging a sealing member for sealing an opening portion between a toner frame and a developing frame.

Another object and feature of the present invention is to provide a process cartridge and an electrophotographic image forming apparatus to which such a process cartridge can detachably be mounted, in which a sealing member for sealing an opening portion between a toner frame and a developing frame can easily be positioned.

DETAILED DESCRIPTION OF THE PREFERRED EMBODIMENTS

I. Construction of Electrophotographic Image Forming Apparatus and Process Cartridge First of all, an electrophotographic image forming apparatus according to a preferred embodiment of the present invention will be explained with reference to FIG. 1.

Figure 1:
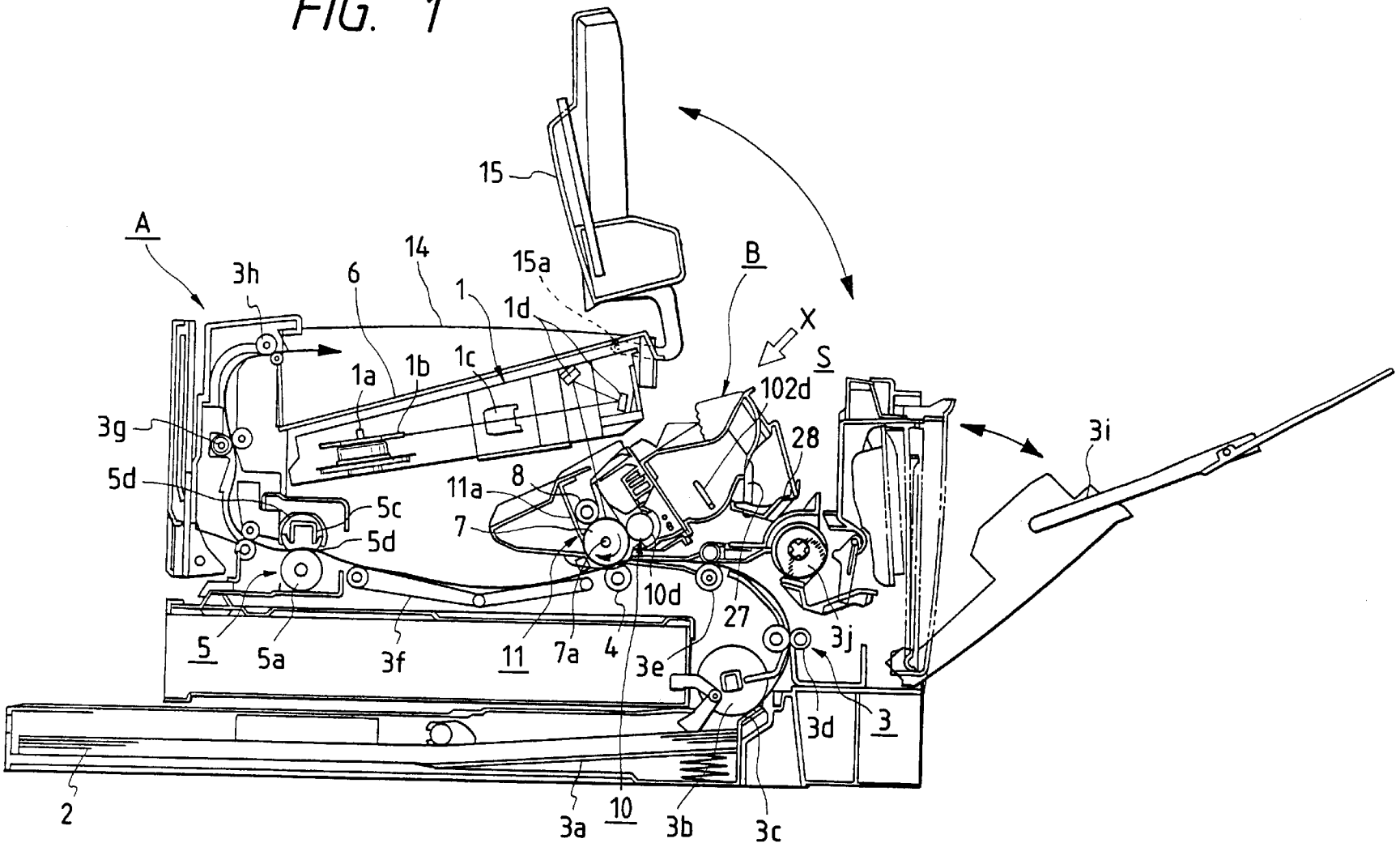
FIG. 1 is a schematic constructural view of an electrophotographic image forming apparatus to which a process cartridge according to a preferred embodiment of the present invention is mounted.

As shown in FIG. 1, in the electrophotographic image forming apparatus A, information light (laser beam) corresponding to image information and emitted from an optical system 1 illuminates a drum-shaped electrophotographic photosensitive member (referred to as "photosensitive drum" hereinafter) 7 of a process cartridge B to form a latent image on the photosensitive drum 7. The latent image is developed with a developing agent (referred to as "toner" hereinafter) to form a toner image. In synchronism with formation of the toner image, a recording medium (for example, recording sheet) 2 is separated and supplied, one-by-one, from a cassette 3*a* by means of a pick-up roller 3*b* and an urging member 3*c* urged against the pick-up roller. The supplied recording medium 2 is conveyed by a convey means 3 comprised of a pair of convey rollers 3*d* and a pair of regist rollers 3*e*. The toner image formed on the photosensitive drum is transferred onto the recording medium 2 by applying voltage to a transfer roller (transfer means) 4. Then, the recording medium 2 is sent to a fixing means 5 by a convey belt 3*f*. The fixing means 5 comprises a drive roller 5*a*, and a fixing rotary member 5*d* having a heater 5*b* therein and formed from a cylindrical sheet rotatably supported by a support 5*c*. When the recording medium 2 is being passed through the fixing means, heat and pressure are applied to the recording medium, thereby fixing the transferred toner image to the recording medium. Thereafter, the recording medium 2 is conveyed by pairs of discharge rollers 3*g*, 3*h* and is discharged onto a discharge portion 6.

On the other hand, in the process cartridge B, the photosensitive drum 7 having a photosensitive layer is rotated. A surface of the photosensitive drum 7 is uniformly charged by applying voltage to a charge roller (charge means) 8. The laser beam (information light) emitted from the optical system 1 illuminates the charged photosensitive drum 7 through an exposure opening portion 9 to expose the photosensitive drum, thereby forming the latent image on the photosensitive drum 7. The latent image is developed by a developing means 10 to form the toner image. Then, the toner image is transferred onto the recording medium 2. Thereafter, residual toner remaining on the surface of the photosensitive drum 7 is removed by a cleaning means 11.

In the electrophotographic image forming apparatus A, a recording medium can be supplied manually through a foldable manual insertion tray 3*i* pivotally mounted on a main body of the image forming apparatus and a roller 3*j*. Further, the process cartridge B is inserted into a cartridge mounting portion S within the main body 14 of the image forming apparatus from a direction shown by the arrow X after an openable member 15, rotatably attached to a shaft 15*a* at an upper part of the main body 14 of the image forming apparatus, is opened. As a result, the process cartridge B is detachably mounted to cartridge mounting guides (cartridge mounting means) (not shown) provided on both sides of the cartridge mounting space S (both sides in a direction of an axis 7*a* of the photosensitive drum 7). In FIG. 1, the reference numeral 1*a* denotes a laser light source; 1*b* denotes a polygon mirror; 1*c* denotes a lens; and 1*d* denotes a reflection mirror. These elements 1*a* to 1*d* are included in the optical system 1.

II. Construction and Internal Structure of Housing of Process Cartridge

Figure 2:
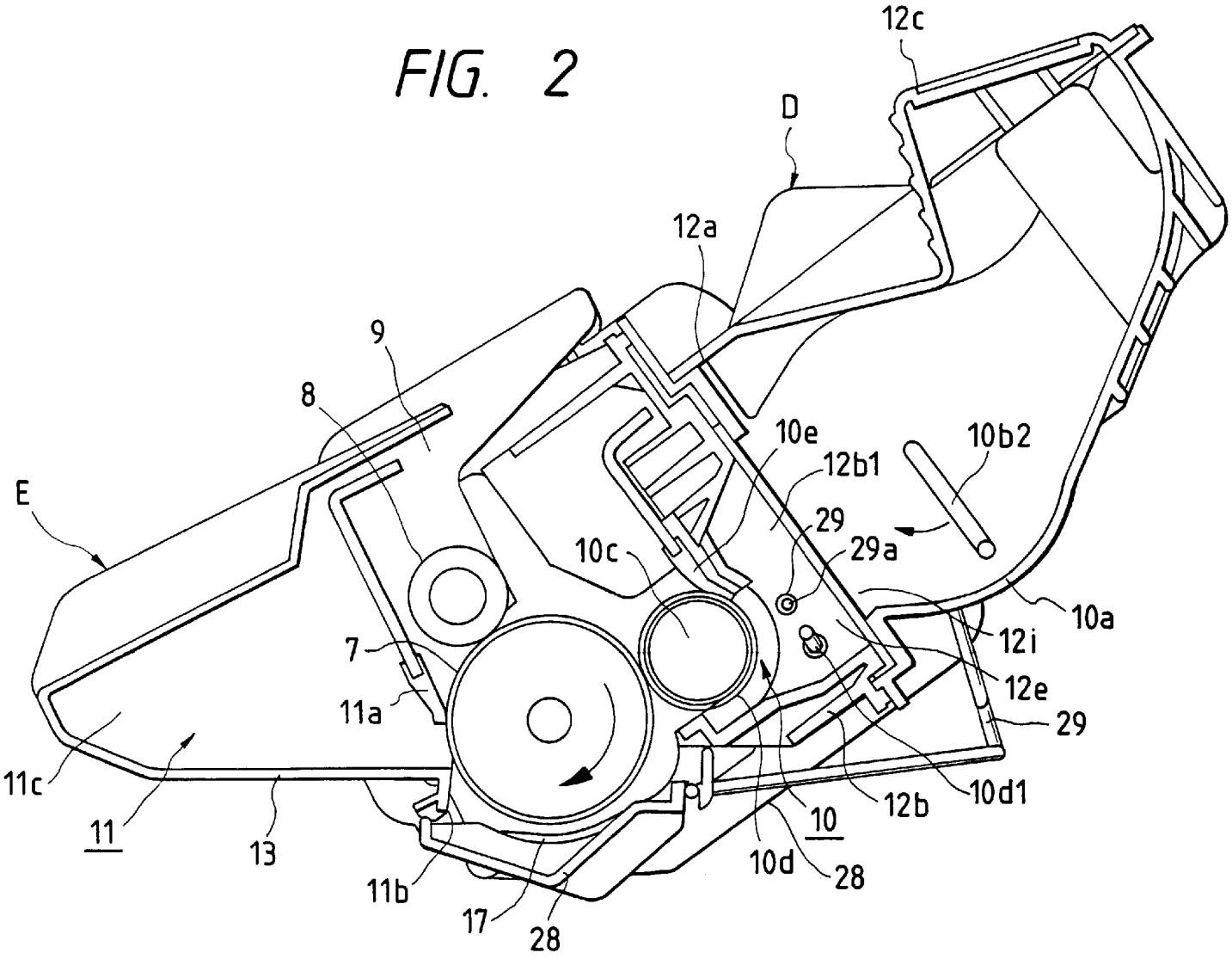
FIG. 2 is a side sectional view of the process cartridge.

Next, the construction and internal structure of a housing of the process cartridge will be explained with reference to FIG. 2.

The process cartridge B is constituted by joining a toner frame 12*a* having a lid member 12*c* and a toner containing portion 10*a* containing the toner to a developing frame 12*b* supporting the developing means such as a developing roller 10*d* and the like. In this way, a developing unit D is formed. Further, the photosensitive drum 7, the charge roller 8 and the cleaning means 11, such as a cleaning blade 11*e* and the like, are attached to a cleaning frame 13, thereby obtaining a cleaning unit E. By pivotally connecting the developing unit D and the cleaning unit E, the process cartridge B is formed. The process cartridge B can detachably be mounted to the main body 14 of the image forming apparatus by an operator.

The process cartridge B is provided with the exposure opening portion 9 through which the information light corresponding to the image information illuminates the photosensitive drum 7, and a transfer opening portion 17 through which the photosensitive drum 7 is opposed to the recording medium 2. More specifically, the exposure opening portion 9 is formed in the cleaning frame 13, and the transfer opening portion 17 is provided between the developing frame 12*b* and the cleaning frame 13.

In the process cartridge B according to the illustrated embodiment, as mentioned above, the developing unit D, having the toner frame 12*a*, and the developing frame 12*b* is pivotally connected to the cleaning unit E having the cleaning frame 13. The photosensitive drum 7, charge roller 8, developing means 10 and cleaning means 11 are contained within the housing. The process cartridge can detachably be mounted to the main body 14 of the image forming apparatus. A drum shutter member 28 is rotatably attached to the developing unit D via a linkage 29 so that, when the process cartridge B is dismounted from the main body 14 of the image forming apparatus, the photosensitive drum 7 is covered by the shutter member to prevent the photosensitive drum from being exposed for a long time and from being contacted by any foreign matter.

The developing means 10 is supported by the developing unit D. The developing means 10 includes a toner feed member (toner feed means) 10*b*2, the developing roller 10*d*, a toner agitating member 10*d*1 and a developing blade 10*e*. The toner feed member 10*b*2 is rotatably supported within the toner containing portion 10*a* of the toner frame 12*a* of the developing unit D. The developing roller 10*d* and toner agitating member 10*d*1 are rotatably supported within a developing chamber 12*b*1 provided in the developing frame 12*b*. The developing blade 10*e* is fixedly supported within the developing chamber 12*b*1 of the developing frame 12*b* and contacts the developing roller 10*d*. In the developing means 10, by rotating the toner feed member 10*b*2, the toner contained in the toner containing portion 10*a* is sent into the developing frame 12*b* through an opening 12*i* provided in the toner frame 12*a* and opening 12*e* provided in the developing frame 12*b*. The toner is agitated by the toner agitating member 10*d*1. The developing roller 10*d*, having a fixed magnet 10*c* therein, is rotated. A toner layer is formed on the surface of the developing roller 10*d* while applying frictional charges to the toner by the developing blade 10*e*. The toner in the toner layer is transferred to the latent image on the photosensitive drum 7, thereby forming the toner image on the photosensitive drum 7.

The cleaning unit E supports the photosensitive drum 7, the charge roller 8 and the cleaning means 11. The photosensitive drum 7 and charge roller 8 are rotatably supported by the cleaning frame 13 and contact each other. The cleaning means 11 includes the cleaning blade 11*a*, a dip sheet 11*b*, and a removed toner containing portion 11*c*. The cleaning blade 11*a* is fixedly supported by the cleaning frame 13 and contacts the photosensitive drum 7. The dip sheet 11*b* is fixedly supported by the cleaning frame 13 below the cleaning blade 11*a*. In the cleaning means 11, after the toner image on the photosensitive drum 7 was transferred to the recording medium 2, residual toner remaining on the photosensitive drum 7 is scraped by the cleaning blade 11*a*. The scraped or removed toner is received by the dip sheet 11*b* and is collected into the removed toner containing portion 11*c*. In this way, the residual toner on the photosensitive drum 7 is removed. Incidentally, the toner image formed on the photosensitive drum 7 is transferred onto the recording medium 2 by applying voltage having a polarity opposite to that of the toner image to the transfer roller 4 provided in the main body 14 of the image forming apparatus.

The developing frame 12*b* is provided with a toner amount detecting means. The toner amount detecting means 29 has a metallic antenna wire 29*a* extending in parallel with the developing roller lad and disposed in a toner supply passage from the toner containing portion 10*a* to the developing roller 10*d* of the developing chamber 12*b*1. The toner amount detecting means 29 serves to detect a remaining amount of toner by detecting a change in electrostatic capacity between the antenna wire 29*a* and the developing roller 10*d* when voltage is applied to the developing roller 10*d*. That is to say, the toner amount is detected by utilizing a phenomenon in which, if there is the toner between the antenna wire 29*a* and the developing roller 10*d*, the electrostatic capacity therebetween becomes small and if there is no toner between the antenna wire 29*a* and the developing roller 10*d*, the electrostatic capacity therebetween becomes great. In this way, the absence of toner can be judged. More particularly, the fact that the remaining amount of toner reaches a predetermined value is judged. Incidentally, the judgement of the toner remaining amount is effected for every electrophotographic image forming process.

III. Joint Structure Between Developing Unit and Cleaning Unit

Figure 3:
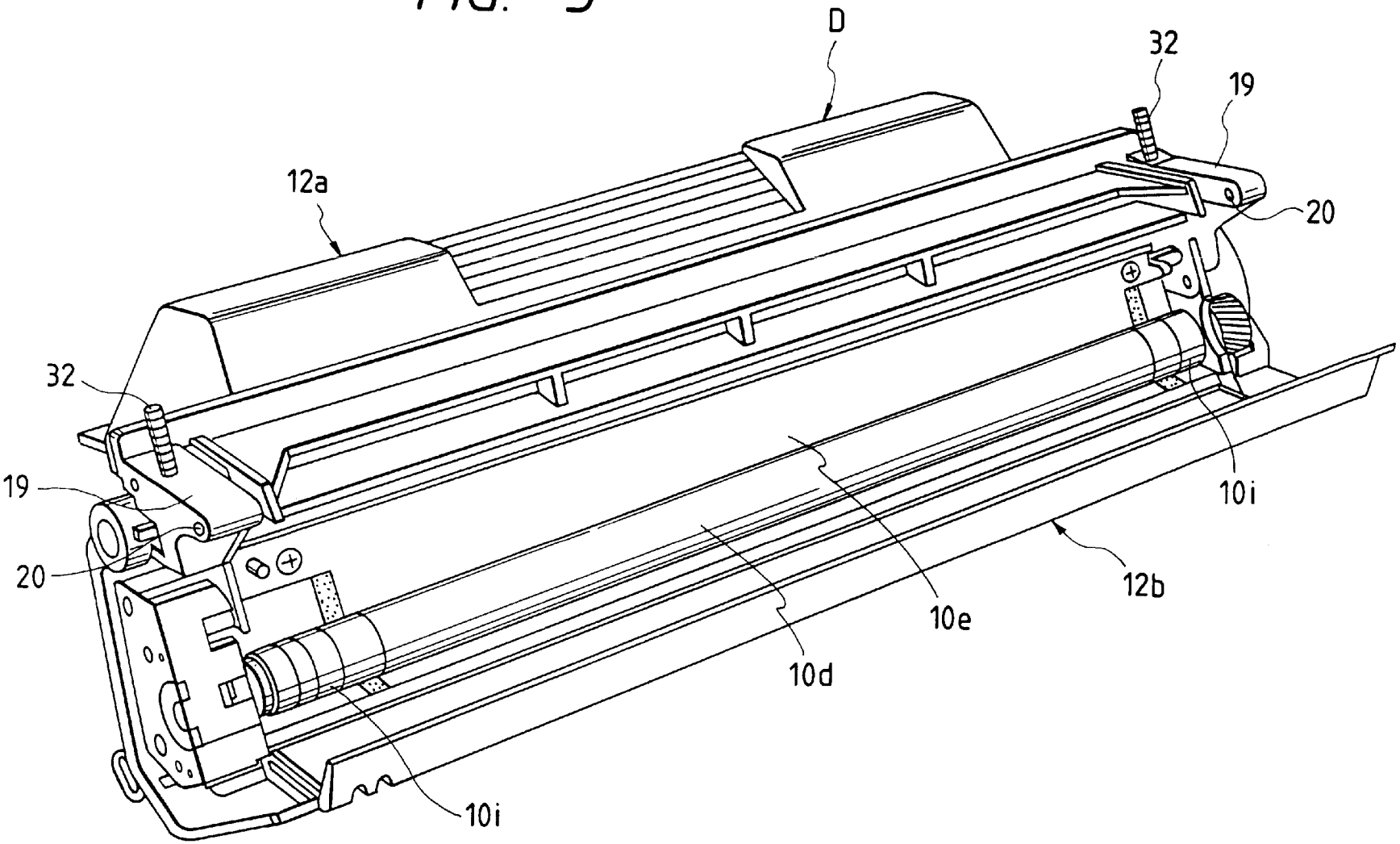
FIG. 3 is a perspective view of a developing unit of the process cartridge, looked at from a developing roller side.

Next, a joint structure between the developing unit D and the cleaning unit E will be explained with reference to FIGS. 3 and 4.

Figure 4:
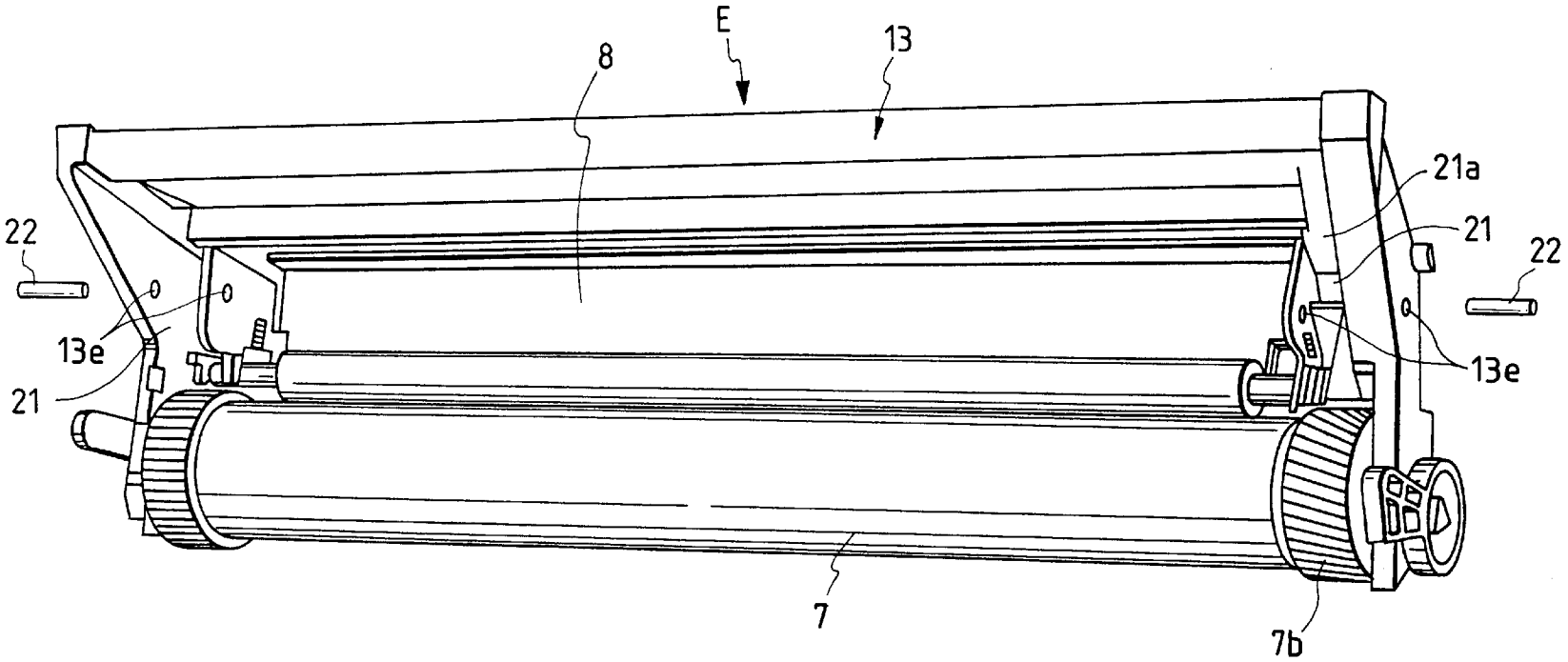
FIG. 4 is a perspective view of a cleaning unit of the process cartridge, looked at from a photosensitive drum side.

The developing unit D and cleaning unit E are rotatably joined to each other by round joint pins 22 (FIG. 4). That is to say, as shown in FIG. 3, circular holes 20 extending parallel with the developing roller 10*d* are formed in tip end portions of arm portions 19 provided on both longitudinal sides (longitudinal direction of the developing roller 10*d*) of the developing frame 12*b*. On the other hand, as shown in FIG. 4, two recesses 21, into which the arm portions 19 enter, are formed in both longitudinal end portions of the cleaning frame 13. The arm portions 19 are inserted into the recesses 21. Then, the joint members 22 are forcibly fitted into attachment holes 13*e* of the cleaning frame 13 and into the circular holes 20 of the arm portions 19 and into inner attachment holes 13*e*. In this way, the developing unit D and cleaning unit E are joined together for rotation around the joint members 22.

In this case, compression coil springs 32 mounted on pegs (not shown) formed on root portions of the arm portions 19 abut against upper walls 21*a* of the recesses 21 of the cleaning frame 13. The developing frame 12*b* is biased downwardly by the compression coil springs 32. As a result, the developing roller 10*d* is surely urged against the photosensitive drum 7. Incidentally, the upper walls 21*a* of the recesses 21 of the cleaning frame 13 are inclined so that, when the developing unit D and cleaning unit E are assembled together, compression of the compression coil springs 32 is gradually increased. Accordingly, as shown in FIG. 3, by providing spacer sub-rollers 10*i* having a diameter greater than that of the developing roller 10*d* on both longitudinal ends of the developing roller 10*d*, the spaced sub-rollers 10*i* are urged against the photosensitive drum 7. As a result, the developing roller 10*d* is opposed to the photosensitive drum 7 with a predetermined gap (about 300 μm) therebetween. Therefore, the developing unit D and cleaning unit E can be rotated relative to each other around the joint members 22. Thus, the positional relation between a peripheral surface of the photosensitive drum 7 and a peripheral surface of the developing roller 10*d* can be maintained by elastic forces of the compression coil springs 32.

IV. Driving of Process Cartridge

According to the process cartridge B having the above-mentioned construction, within the housing constituting the cartridge frame, the photosensitive drum 7, the toner feed member 10*b*2 of the developing means 10, the developing roller 10*d* and the toner agitating member 10*d*1 are interconnected for cooperation by means of gear mechanism (not shown). When the process cartridge B is mounted in the cartridge mounting portion S of the main body 14 of the image forming apparatus, a driven gear 7*b* (FIG. 4) of the gear mechanisms provided on both longitudinal ends of the photosensitive drum 7 is engaged by a drive gear (not shown) of the main body 14 of the image forming apparatus. When the drive gear is rotated by a main motor (not shown) of the main body 14 of the image forming apparatus, the driven gear 7*b* of the photosensitive drum 7 is rotatingly driven to rotate the toner feed member 10*b*2, the developing roller 10*d* and the toner agitating member 10*d*1.

Incidentally, the process cartridge B is provided with an earth contact for the photosensitive drum 7, a charge bias contact for the charge roller 8, a developing bias contact for the developing roller 10*d* and a toner amount detect contact (all are not shown), which contacts are disposed at predetermined positions on the surface of the housing. When the process cartridge B is mounted in the cartridge mounting portion S, these electrical contacts are electrically connected to corresponding electrical contacts (not shown) of the main body 14 of the image forming apparatus.

V. Joint Structure Between Toner Frame and Developing Frame of Developing Unit Next, the joint structure between the toner frame 12*a* and the developing frame 12*b* will be explained with reference to FIGS. 5 to 7.

Figure 5:
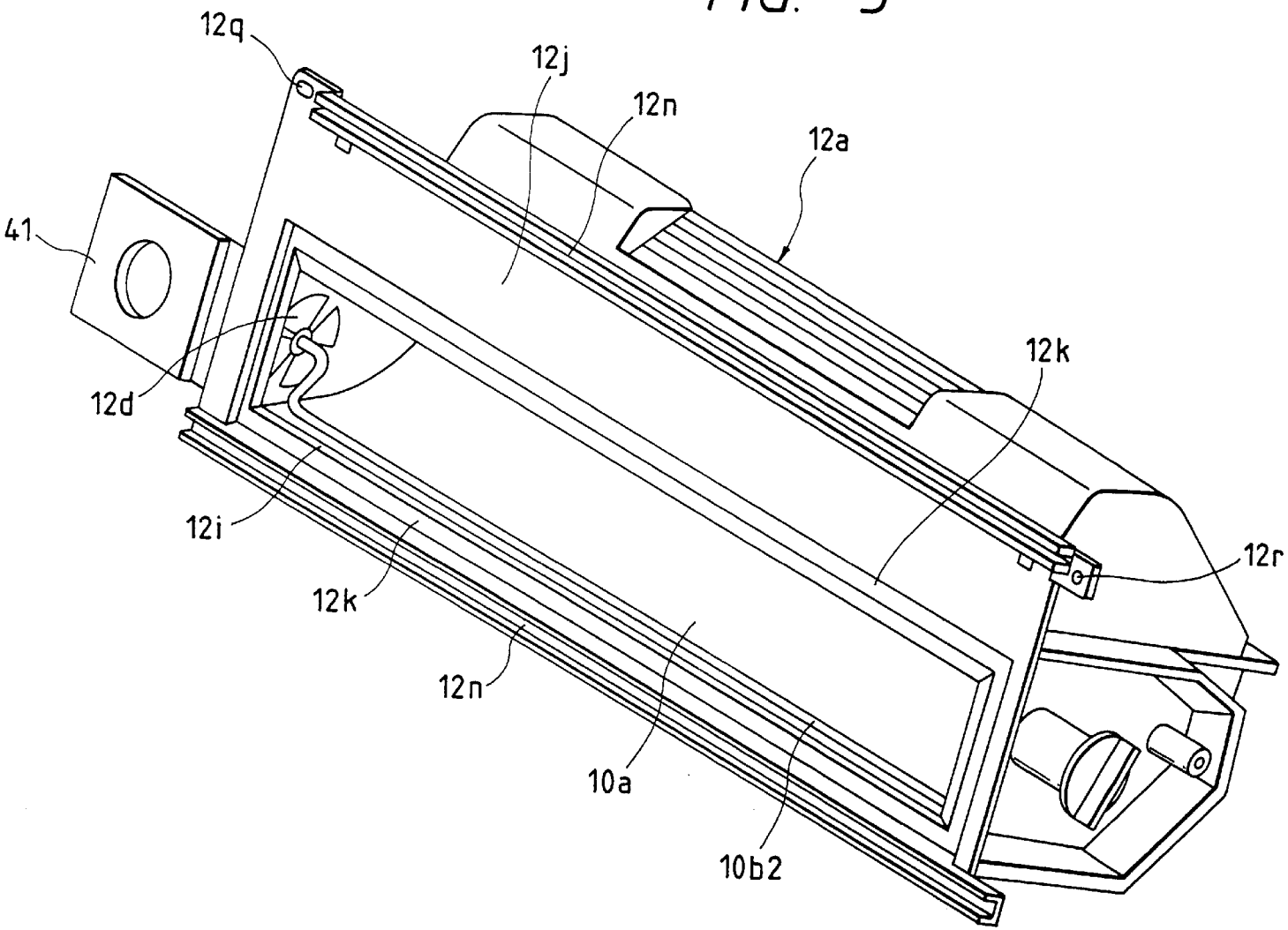
FIG. 5 is a perspective view of a toner frame of the process cartridge, looked at from a developing frame side.

As shown in FIG. 5, the toner frame 12*a* has an opening portion 12*i* through which the toner is sent from the toner containing portion 10*a* to the developing frame 12*b*, which opening portion is formed in a surface of the toner frame opposed to the developing frame 12*b*. Further, the toner frame 12*a* has a recessed surface 12*k* disposed around the opening portion 12*i*, and a flat flange (interface) 12*j* provided around the recessed surface 12*k*. The flange 12*j* is provided at its upper and lower edge portions with two longitudinal parallel grooves 12*n* (extending in the axial direction of the photosensitive drum 7).

Figure 6:
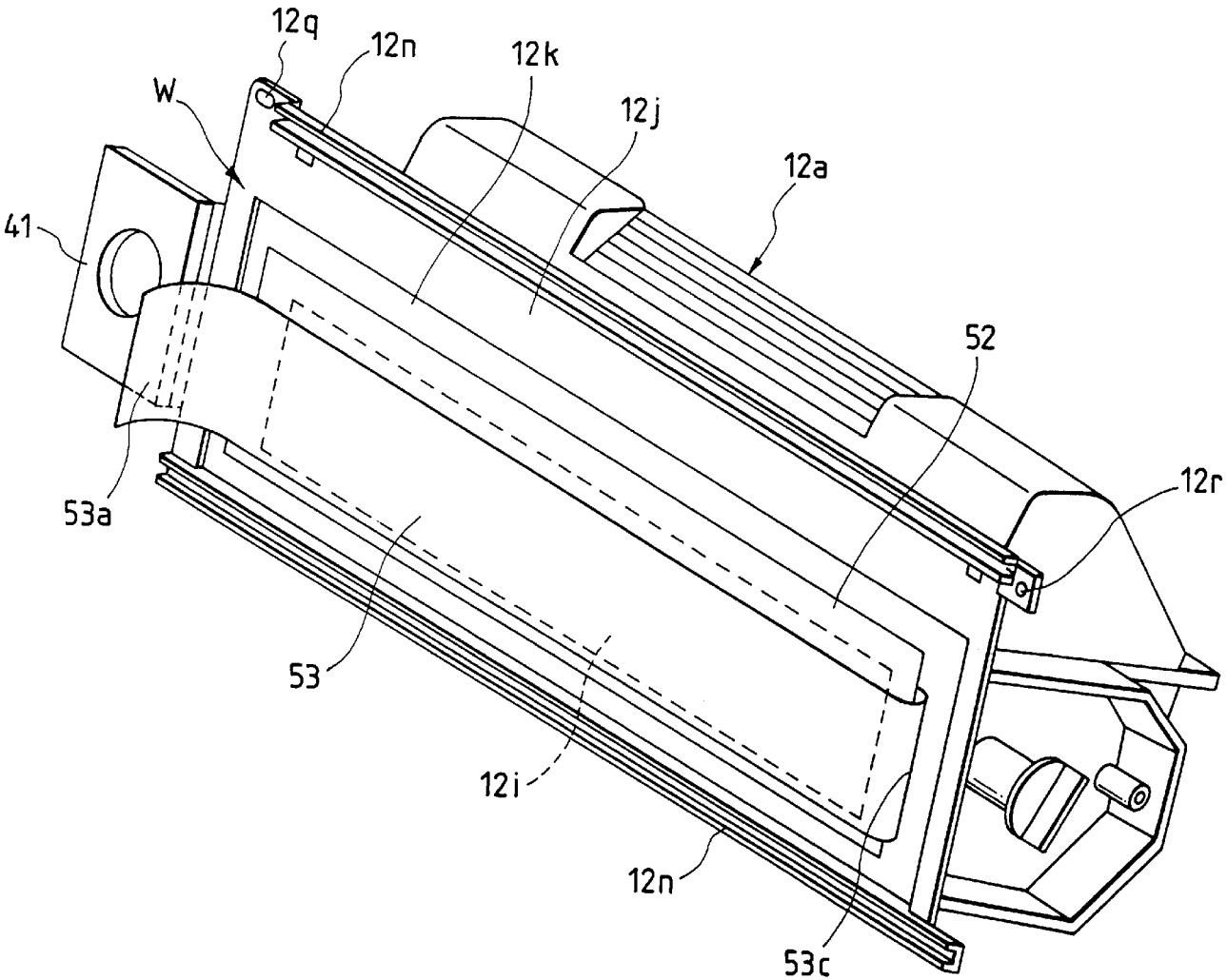
FIG. 6 is a perspective view showing a condition that a cover film is attached to the toner frame of the process cartridge.

In order to close and seal the opening portion 12*i* of the toner frame 12*a* before the toner frame is joined to the developing frame 12*b*, a cover film or toner seal (sealing member) 52 peelable in the longitudinal direction is adhered to the recessed surface 12*k* of the toner frame 12*a* (FIG. 6). As shown in FIG. 6, the cover film 52 is adhered to the toner frame 12*a* at the recessed surface 12*k* along four edge portions of the opening portion 12*i*. A tear tape 53, for tearing the cover film 52 to open the opening portion 12*i*, is adhered to the cover film 52. The tear tape 53 is folded back at one longitudinal end 53*c* of the opening portion 12*i*. At an opposite end, the other end 53*a* of the tear tape extends out of the cartridge through between the toner frame 12*a* and an elastic seal material (seal member) 47 (FIG. 7) adhered to a longitudinal end of a flange 12*u* (to be described later) of the developing frame 12*b* opposed to the flange 12*j* of the toner frame 12*a*. The other end 53*a* of the tear tape 53 is attached to a grip 41 integrally formed with the toner frame 12*a*. A portion of the grip 41 connected to the toner frame 12*a* is thinned or weakened to permit easy separation of the grip from the toner frame.

Figure 7:
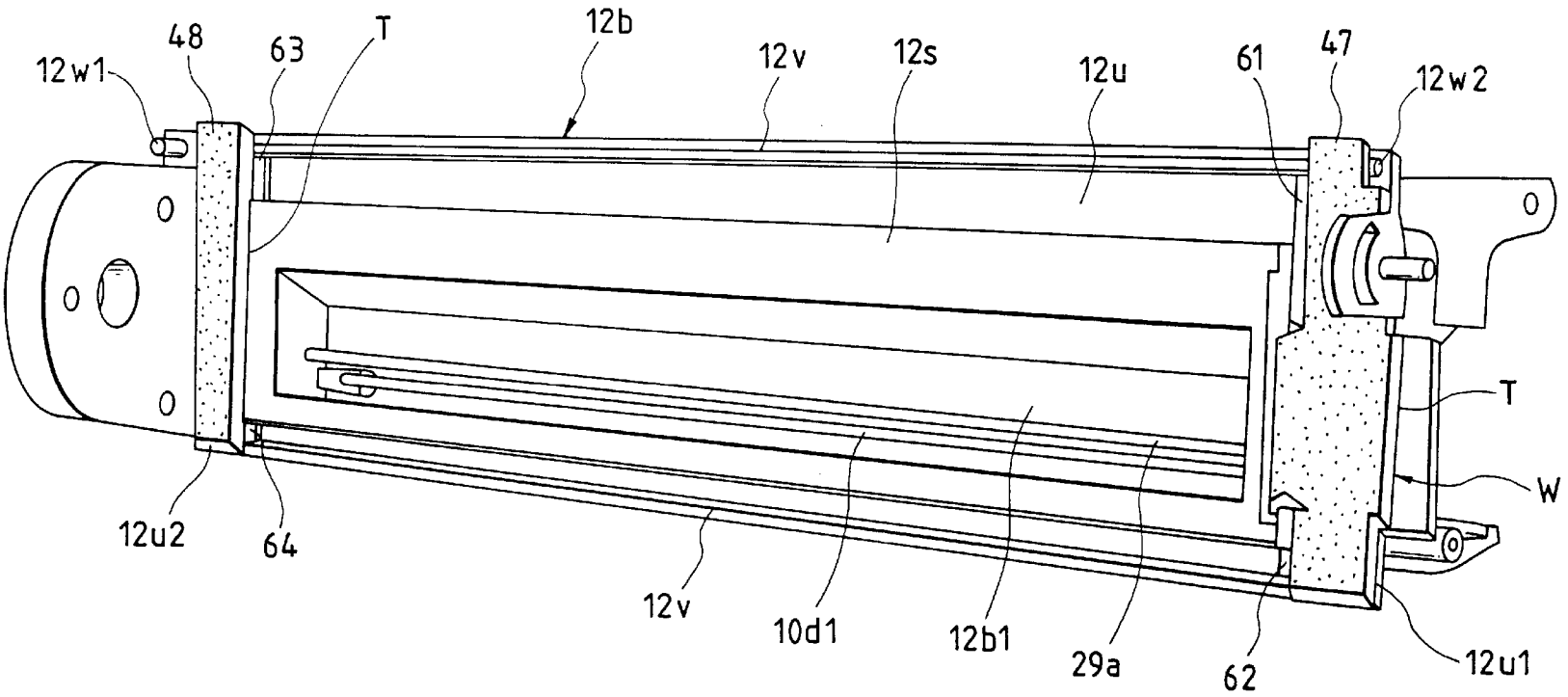
FIG. 7 is a perspective view of the developing frame of the process cartridge, looked at from the toner frame side.

As shown in FIG. 7, the developing frame 12*b* has an opening portion 12*e* for directing the toner from the toner frame 12*a* to the developing chamber 12*b*1 (which is formed in a surface of the developing frame opposed to the toner frame 12*a*), a protruded surface 12*s* adapted to be fitted into the recessed surface 12*k* of the toner frame 12*a* and disposed around the opening portion 12*e*, and a flat flange (interface) 12*u* provided around the protruded surface 12*s*. The flange 12*u* is provided at its upper and lower edge portions with two longitudinal parallel ridges (protruded portions) 12*v* (extending in the axial direction of the photosensitive drum 7). The ridges 12*v* have dimensions to be received in the grooves 12*n* of the toner frame 12*a* with any play. Triangular projections 41 (FIGS. 8A and 8B) adapted to be welded to the bottoms of the grooves 12*n* of the toner frame 12*a* by ultrasonic welding are formed on the tops of the ridges.

An elastic seal material (seal member) 47 made of felt or foamed rubber is adhered to one longitudinal end of the flange 12*u* of the developing frame 12*b*. The elastic seal material 47 closes or seals a peeling opening W (FIG. 6) (through which the tear tape is pulled out) formed between the flanges 12*j* and 12*u* at the side of the other end 53*a* of the tear tape 53 when the toner frame 12*a* and the developing frame 12*b* are joined together. Further, an elastic seal material 48 made of material the same as that of the elastic seal material 47 is adhered to the other longitudinal end of the flange 12*u* of the developing frame 12*b*.

The above-mentioned elastic seal materials 47, 48 are adhered to both longitudinal ends of the flange 12*u* of the developing frame 12*b* along their entire lengths by two-sided adhesive tapes (two-sided adhesive members). The elastic seal materials 47, 48 are aligned with both longitudinal ends of the flange 12*j* of the toner frame 12*a* and are overlapped with the ridges 12*v* of the developing frame 12*b* in the width-wise direction of the flange 12*j*.

Furthermore, when the toner frame 12*a* and the developing frame 12*b* are joined together, in order to facilitate the positioning of the frames 12*a*, 12*b*, the flange 12*j* of the toner frame 12*a* is provided with a circular hole 12*r* and a rectangular hole 12*q*. Further, the developing frame 12*b* is provided with a cylindrical dowel 12*w*1 and a prismatic dowel 12*w*2 which are adapted to be fitted into the circular hole 12*r* and the rectangular hole 12*q* of the toner frame 12*a*. The circular hole 12*r* is closely fitted on the cylindrical dowel 12*w*1, and the prismatic dowel 12*w*2 closely contacts only longitudinal edges of the rectangular hole 12*q*.

VI. Joining of Toner Frame and Developing Frame

Before the toner frame 12*a* and the developing frame 12*b* are joined together, the toner frame 12*a* and the developing frame 12*b* are assembled independently as units. In assembling the opening portion 12*i* of the toner frame 12*a* is closed or sealed by the cover film (toner seal) 52 and the tear tape 53. Thereafter, the toner is loaded through a toner loading opening 12*d* (FIG. 5) and then the toner loading opening 12*d* is closed by a toner cap (not shown). Thereafter, the cylindrical dowel 12*w*1 and the prismatic dowel 12*w*2 for positioning the developing frame 12*b* are fitted into the circular hole 12*r* and the rectangular hole 12*q* for positioning the toner frame 12*a*. Further, the ridges 12*v* of the developing frame 12*b* are fitted into the grooves 12*n* of the toner frame 12*a*, respectively. Then, the toner frame 12*a* and the developing frame 12*b* are urged against each other. Incidentally, the elastic seal materials 47, 48 are compressed by both longitudinal ends of the flange 12*j* of the toner frame 12*a* to reduce their thicknesses.

In this condition, the toner frame 12*a* and the developing frame 12*b* are urged against each other. Then, ultrasonic vibration is applied between the ridges 12*v* and the grooves 12*n*. By the frictional heat generated by ultrasonic vibration, the triangular projections 41 on the ridges 12*v* are melted to be bonded to the bottoms of the grooves 12*n*. As a result, the toner frame 12*a* and the developing frame 12*b* are integrally joined together. In this case, a space having a sealed periphery is formed between the recessed surface 12*k* of the toner frame 12*a* and the flange 12*u* of the developing frame 12*b*. The cover film 52 and the tear tape 53 are housed in this space. In this way, the developing unit D shown in FIG. 3 is completed.

VII. Toner Leakage Preventing Structure at the Joint Between Toner Frame and Developing Frame As mentioned above, ridges 12*v* of the developing frame 12*b* are fitted into the grooves 12*n* of the toner frame 12*a*. Then, the toner frame 12*a* and the developing frame 12*b* are urged against each other, and the ultrasonic vibration is applied between the ridges 12*v* and the grooves 12*n*. By the frictional heat generated by ultrasonic vibration, the triangular projections 41 on the ridges 12*v* are melted to be bonded to the bottoms of the grooves 12*n*.

In the illustrated embodiment, damage to the elastic seal materials 47, 48 at the joint portion 12*j*, 12*u* between the toner frame 12*a* and the developing frame 12*b* is prevented. To this end, as shown in FIG. 8A, at the grooves 12*n* of the toner frame 12*a* and the ridges 12*v* of the developing frame 12*b*, inner corners 43, 44 of at least opposed portions, where the elastic seal material 47, 48 are positioned, are inclined in parallel.

Figure 8B:
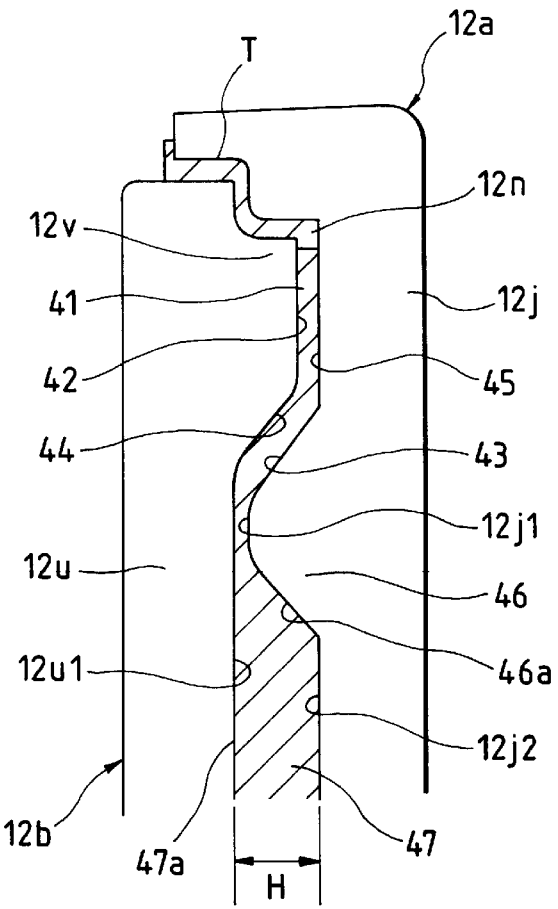
FIG. 8B is a partial enlarged sectional view showing the toner leakage preventing structure between the toner frame and the developing frame of the process cartridge before welding.
Figure 8A:
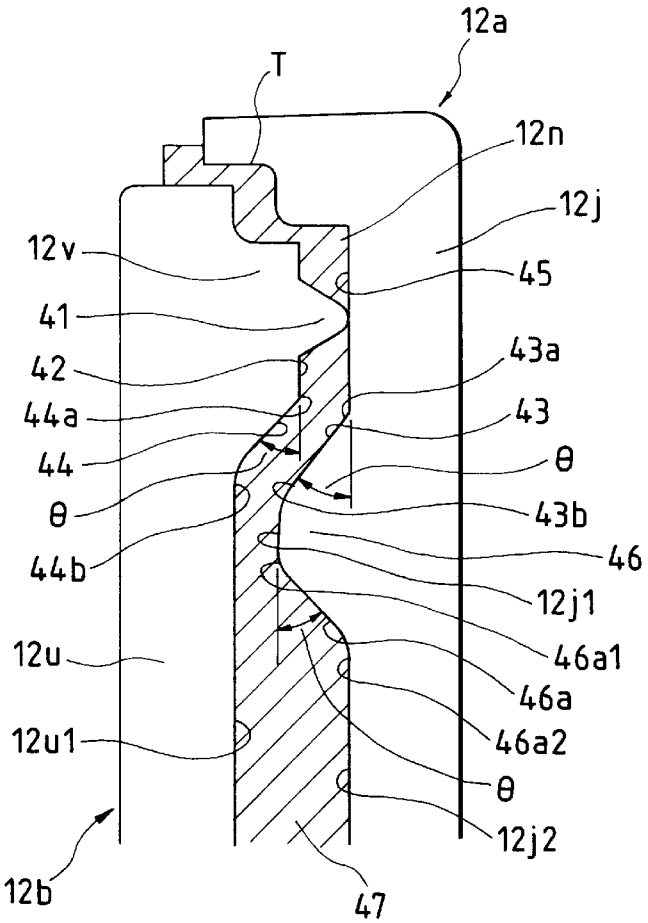
FIG. 8A is a partial enlarged sectional view showing a toner leakage preventing structure between the toner frame and the developing frame of the process cartridge before welding.

More specifically, as shown in FIG. 8A, the inner corners 44 of the ridges 12*v* of the developing frame 12*b* are provided with inclined surfaces, each having an angle θ of about 45° with respect to the tops 42 on which the triangular projections 41 are positioned. Further, the inner corners 43 of the grooves 12*n* of the toner frame 12*a* opposed to the inner corners (inclined surfaces) 44 are provided with inclined surfaces, each having an angle θ of about 45° with respect to the bottoms 45 parallel with the tops 42 of the ridges 12*v*. In this way, the inner corners 44 of the ridges 12*v* and the inner corners 43 of the grooves 12*n* have parallel inclined surfaces.

Further, the inner corners 44 are chamfered at side edges 44*a* of the top surfaces 42 and side edges 44*b* of the flat surface 12*u*1 of the flange 12*u*, and the surfaces are smoothly extended from the top surfaces 42 to the flat surface 12*u*1 of the flange 12*u*. On the other hand, the inner corners 43 are chamfered at side edges 43*a* of the bottom surfaces 45 and side edges of inner ridges 46 provided on the flange 12*j* inside of the grooves 12*n*, and the surfaces are smoothly extended from the bottom surfaces 45 to an upper surface 12*j*1. Surfaces 46*a* of the inner ridges 46 remote from the inner corners 43 have inclined surfaces having an angle θ of about 45° with respect to the upper surface 12*j*1 of the flange 12*j*. Damage to the elastic seal materials 47, 48 is prevented between the inclined surfaces 46*a* and the flat surface 12*u*1. Upper and lower side edges 46*a*1, 46*a*2 of the inclined surfaces of the inner ridges 46 are chamfered. The inclined surfaces are smoothly extended from the upper surface 12*j*1 to a flat surface 12*j*2 of the flange 12*j*.

The ridges 12*v* of the developing frame 12*b* are fitted into the grooves 12*n* of the toner frame 12*a* so constructed. And, the toner frame 12*a* and the developing frame 12*b* are urged against each other, and the ultrasonic vibration is applied between the ridges 12*v* and the grooves 12*n*. By the frictional heat generated by ultrasonic vibration, the triangular projections 41 on the ridges 12*v* are melted to be bonded to the bottoms of the grooves 12*n*. As shown in FIG. 8B, between the flanges 12*u* and 12*j* of the frames 12*a*, 12*b*, the elastic seal materials 47, 48 are pinched between inner corners (parallel surfaces) 44, 43 and the upper surfaces 12*j*1 of the inner ridges 46 of the toner frame 12*a* and the opposed flat surfaces 12*u*1 of the developing frame 12. Accordingly, there is no shearing force tending to tear the elastic seal materials 47, 48 and the two-sided adhesive tapes T. Thus, toner leakage due to damage to the elastic seal materials 47, 48 and the two-sided adhesive tapes T can surely be prevented. In particular, the sealing function of the elastic seal material 47 and the adhering function of the two-sided adhesive tape T positioned at the drawing side of the cover film 52 (the other end 53*a* side of the tear tape 53) are maintained. Accordingly, the toner leakage through the unsealing opening W due to the damage of the elastic seal material 47 can be prevented.

Further, at the grooves 12*n* of the toner frame 12*a* and the ridges 12*v* of the developing frame 12*b*, both side edges 44*a*, 44*b*, 43*a*, 43*b* of the inner corners (parallel inclined surfaces) 44, 43 and both side edges 46*a*1, 46*a*2 of the inner ridges 46 of the toner frame 12*a* are chamfered. Accordingly, the elastic seal materials 47, 48 can easily be adhered to the grooves 12*n* of the toner frame 12*a* and the ridges 12*v* of the developing frame 12*b* by the two-sided adhesive tapes T.

The inclined angles of the inner corners 44, 43 or the inclined angles θ of the inclined surfaces 46*a* of the inner ridges 46 of the toner frame 12*a* are not limited to 45° , but, for example, may be 30° to 60° with the same advantage. However, if the inclined angles are not included within this angle range, since the bonding force is decreased and the elastic seal materials 47, 48 are hard to be adhered to, the inclined angles of 30° to 60° are desirable.

Figure 9:
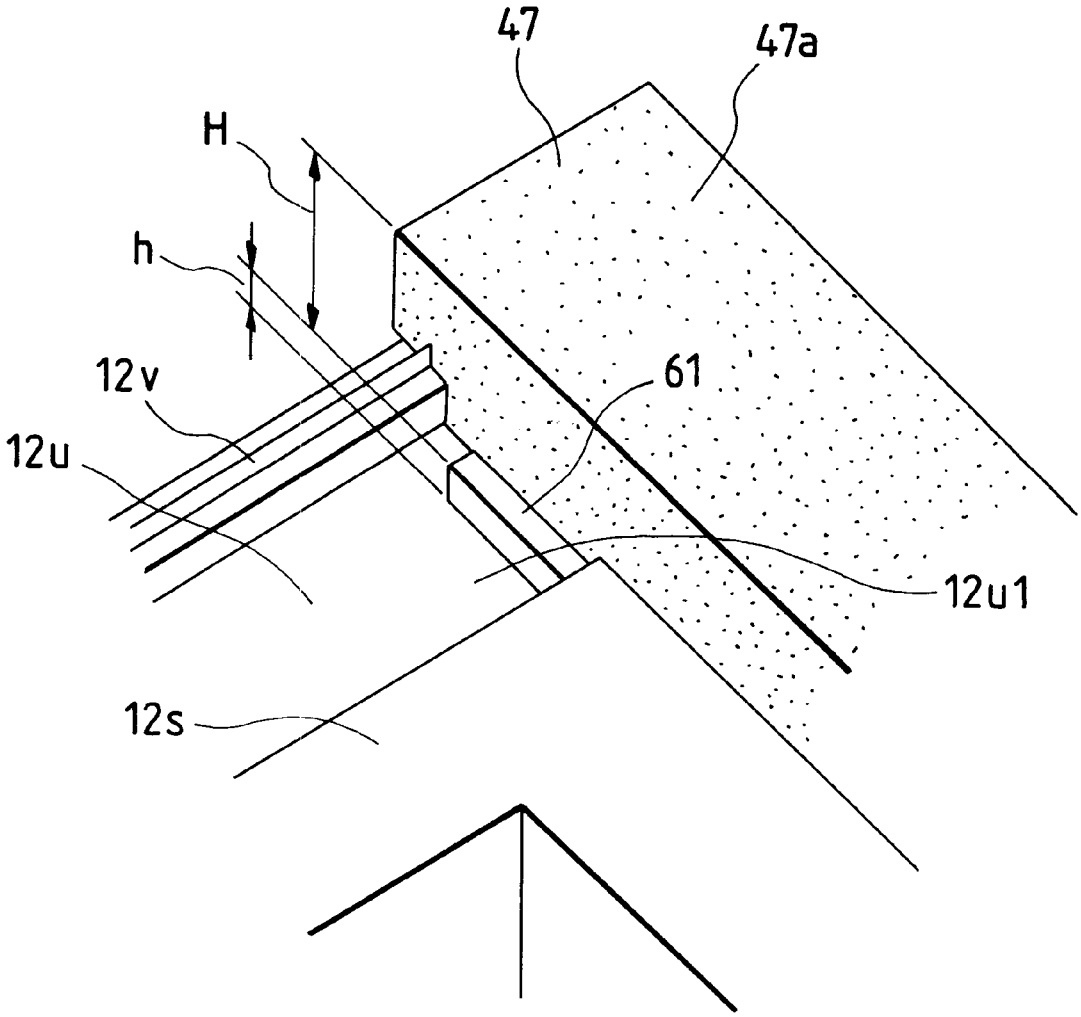
FIG. 9 is a partial enlarged perspective view of a toner leakage preventing structure for preventing toner leakage due to poor positioning and poor attaching of an elastic seal member in the process cartridge.

VIII. Toner Leakage Preventing Structure for Preventing Toner Leakage Due to Poor Positioning and Poor Attaching of Elastic Seal Materials In the illustrated embodiment, the positioning of the elastic seal materials 47, 48 is facilitated and the toner leakage due to poor attaching of the elastic seal materials 47, 48 is prevented. To this end, as shown in FIG. 7, protruded steps 61, 62, 63 and 64 are provided inside of adhering seat surface (attachment surfaces) 12*u*1, 12*u*2 for the elastic seal members 47, 48 at both longitudinal ends of the flange 12*u*, which protruded steps act as adhering references for the elastic seal materials 47, 48 and serve to minimize toner escape if the poor attaching of the elastic seal materials 47, 48 is effected. As shown in FIGS. 6 and 9, the protruded steps 61 to 64 are positioned outside of a convex surface 12*s* of the developing frame 12*b*. Further, the protruded steps are extended up to the vicinity of a flange (not shown) of the toner frame which is to be joined, exceeding the adhering seat surfaces 12*u*1, 12*u*2 to which the elastic seal members 47, 48 are adhered by the two-sided adhesive tapes T.

More specifically, the protruded steps 61 to 64 extend up to the vicinity of the ridges 12*v*, exceeding the adhering seat surface 12*u*1, for example, shown as the protruded step 61 in FIG. 9. Heights h of the protruded steps 61 to 64 are limited not to interfere with the flange during the joining and welding between the toner frame 12 and the developing frame 12*b*. That is to say, in the joining and welding between the toner frame 12 and the developing frame 12*b*, the heights h of the protruded steps 61 to 64 are smaller than a height H (FIG. 8B) between the flat surface 12*u*1 of the flange 12*u* of the developing frame 12*b* and the upper surfaces 47*a* of the elastic seal members 47, 48 (H>h).

When the elastic seal materials 47, 48 are adhered to the adhering seat surfaces 12*u*1, 12*u*2 of the developing frame 12*b*, they can be adhered by the two-sided adhesive tapes T along outer side surfaces of the upper and lower protruded steps 61, 62, 63 and 64 at both longitudinal ends of the flange 12*j*. Accordingly, the elastic seal materials 47, 48 can easily be adhered to the adhering seat surfaces 12*u*1, 5 12*u*2 of the developing frame 12*b*.

Further, if poor adhering of the elastic seal materials 47, 48 occurs at the protruded steps 61, 62, 63 and 64, since the protruded steps 61, 62, 63 and 64 protrude up to the vicinity of the flange 12*j* of the toner frame 12*a* exceeding the adhering seat surfaces 12*u*1, 12*u*2 of the developing frame 12*b*, toner leakage due to the poor attaching of the elastic seal members 47, 48 can be prevented.

In the process cartridge B having the above-mentioned construction, in order to feed the toner contained in the toner frame 12*a* to the developing frame 12*b*, the root of the grip 41, to which the other end 53*a* of the tear tape 53 protruded from the process cartridge B, is separated from the cartridge. Thereafter, by pulling the grip 41, the tear tape 53 is pulled out. In this case, the cover film 52 is torn to open the opening portion 12*i* of the toner frame, thereby sending the toner from the toner frame 12*a* to the developing frame 12*b*. Since the elastic seal members 47, 48 are deformed to decrease their thicknesses at both longitudinal ends of the flange 12*j* of the toner frame 12*a*, good sealing ability can be obtained.

Since the interface (joint surfaces) between the toner frame 12*a* and the developing frame 12*b* is so formed, when the force for tearing the cover tape 52 is applied to the tear tape 53, the tear tape 53 can smoothly be pulled between the frames 12*a* and 12*b*.

As mentioned above, the process cartridge B according to the illustrated embodiment has the toner leakage preventing structure at the interface between the toner frame and the developing frame and the toner leakage preventing structure for preventing toner leakage due to the poor positioning and poor attaching of the elastic seal materials. The elastic seal members 47, 48 can be pinched between the inner corners (parallel surfaces) 44 and 43 of the grooves 12*n* and the ridges 12*v* of the flanges 12*j* and 12*u* of the toner frame 12*a* and the developing frame 12*b*. In this way, the toner frame 12*a* and the developing frame 12*b* can be joined together without damaging the elastic seal materials 47, 48 and the two-sided adhesive tapes T. Further, no toner leakage occurs through the opening W positioned at the longitudinal end of the flanges 12*j*, 12*u* of the toner frame 12*a* and the developing frame 12*b* and through the other longitudinal end. Since the steps 61, 62, 63 and 64 provided on the developing frame 12*b* extend the vicinity of the flange 12*j* of the toner frame 12*a* exceeding the adhering seat surfaces 12*u*1, 12*u*2 for adhering the elastic seal materials 47, 48 to the flange 12*u* of the developing frame 12*b*, the elastic seal materials 47, 48 can easily be positioned and adhered to the adhering seat surfaces 12*u*1, 12*u*2 of the developing frame 12*b*. In addition, toner leakage between the adhering seat surfaces 12*u*1, 12*u*2 of the developing frame 12*b* and the elastic seal materials 47, 48 can be prevented.

Accordingly, in the electrophotographic image forming apparatus using the process cartridge B, when the process cartridge B is dismounted for sheet jam treatment or when the process cartridge B is shaken to use up the toner at the end of the service life of the process cartridge B, toner leakage through the opening W and between the elastic seal material 48 disposed opposite to the opening W and the adhering seat surface 12*u*2 of the developing frame 12*b* can be prevented.

IX. Other Alterations

In the illustrated embodiment, while an example of a process cartridge B, having a toner leakage preventing structure at the interface between the toner frame and the developing frame, and the toner leakage preventing structure for preventing toner leakage due to the poor positioning and poor attaching of the elastic seal materials, was explained, such structures can be appropriately selected on demand. For example, a process cartridge may have only the toner leakage preventing structure at the interface between the toner frame and the developing frame, or only the toner leakage preventing structure for preventing toner leakage due to the poor positioning and poor attaching of the elastic seal materials.

Further, in the toner leakage preventing structure at the interface between the toner frame and the developing frame, while an example of ridges formed on the developing frame and grooves formed in the toner frame was explained, the ridges may be formed on the toner frame and the grooves may be formed in the developing frame.

Further, while an example of elastic seal materials adhered to the developing frame was explained, the elastic seal materials may be adhered to the toner frame. In this case, the toner leakage preventing structure for preventing toner leakage due to the poor positioning and poor attaching of the elastic seal materials can be applied to the toner frame.

In addition, the toner frame 12*a* and the developing frame 12*b* of the developing unit D may be formed from plastic such as polystyrene, ABS (acrylonitrile/buthadiene/styrene copolymer) resin, polycarbonate, polyethylene, or polypropylene.

Further, while an example of a process cartridge B used for the formation of a mono-color image was explained, in the process cartridge, a plurality of developing means may be provided to form plural color images (for example, a two-color image, a three-color image or a full-color image), as well as a mono-color image.

The developing method may be a known two-component magnetic brush developing method, a cascade developing method, a touch-down developing method, or a cloud developing method.

The toner seal may be formed as an easy peel type comprised of a folded single sheet, as well as the seal comprised of the cover film 52 and the tear tape 53.

The electrophotographic photosensitive member is not limited to the photosensitive drum, but may be the following. A photo-conductor is used as the photosensitive body, and the photo-conductor may be amorphous silicone, amorphous selenium, zinc oxide, titanium oxide or organic photoconductor (OPC). The electrophotographic photosensitive member may be mounted on a drum-shaped rotary member, a belt-shaped rotary member or a sheet. Incidentally, in general, the drum-shaped rotary member or the belt-shaped rotary member is used, and, for example, in a drum type electrophotographic photosensitive member, the electrophotographic photosensitive body is deposited or coated on a cylinder made of aluminum alloy.

In the illustrated embodiment, while an example of charge means of the contact-charging type was explained, the charge means may be constructed, as is already known, by covering three walls formed from tungsten wires by a metallic (for example, aluminium) shield, in which positive or negative ions generated by applying high voltage to the tungsten wires are transferred to the surface of the photosensitive drum, thereby uniformly charging the surface of the photosensitive drum. Incidentally, the charge means may be a blade type (charge blade), a pad type, a block type, a rod type or a wire type, as well as a roller type.

Further, the cleaning means for cleaning the residual toner remaining on the photosensitive drum may be a fur brush or a magnet brush, as well as the cleaning blade.

The process cartridge includes, for example, an electrophotographic photosensitive member, a developing means and at least one process means. Accordingly, other than the above, the process cartridge may incorporate therein an electrophotographic photosensitive member, a developing means and a charge means as a cartridge unit, may incorporate therein an electrophotographic photosensitive member and a developing means as a cartridge unit, or may incorporate therein an electrophotographic photosensitive member, a developing means and a cleaning means as a cartridge unit, all of which can detachably be mounted to an image forming apparatus.

That is to say, in the process cartridge, the charge means or the cleaning means, and the developing means and the electrophotographic photosensitive member are integrally incorporated as the cartridge unit, at least one of the charge means and the cleaning means, and the developing means and the electrophotographic photosensitive member are integrally incorporated as the cartridge unit, or, at least the developing means and the electrophotographic photosensitive member are integrally incorporated as the cartridge unit, all of which can detachably be mounted to the image forming apparatus.

In the illustrated embodiment, while an example of a laser beam printer as the electrophotographic image forming apparatus was explained, the present invention is not limited to such an example, but may be applied to other electrophotographic image forming apparatuses, such as an electrophotographic copying machine, an electrophotographic facsimile, or an electrophotographic word processor.

According to the illustrated embodiment, at the ridges and the grooves in the interface between the toner frame and the developing frame, the inner corners, at least at portions where the seal members are positioned, are provided with the parallel inclined surfaces, or, at the ridges and the grooves in the interface between the toner frame and the developing frame, the inner corners of the top surfaces, at least at portions where the seal members are positioned, are provided with the inclined surfaces. Further, the inner corners (opposed to the inner corners of the ridges) of the bottoms of the grooves where the seal members are positioned are provided with the inclined surfaces parallel with the inclined surfaces of the ridges. Accordingly, the toner frame and the developing frame can be joined together without damaging the seal members. Further, toner leakage through the opening due to the damage of the seal members can be prevented.

Further, since the protruded steps extending up to the vicinity of the joint surface of the developing frame or the toner frame exceeding the adhering seat surfaces for adhering the seal members are formed on the joint surface of the toner frame or the developing frame, the seal members can easily be positioned and attached to the toner frame or the developing frame. Further, the toner leakage through and between the seal member adhering surfaces of the toner frame or the developing frame for securing the seal members and the seal members can be prevented.

In addition, at the ridges and the grooves in the interface between the toner frame and the developing frame, the inner corners of at least the opposed surfaces, where the seal members are positioned, are provided with the parallel inclined surfaces, or, at the ridges and the grooves in the interface between the toner frame and the developing frame, the inner corners of the top surfaces of the ridges, at least at portions where the seal members are positioned, are provided with the inclined surfaces. Further, the inner corners (opposed to the inner corners of the ridges) of the bottoms of the grooves where the seal members are positioned are provided with the inclined surfaces parallel with the inclined surfaces of the ridges. In addition, the protruded steps extending up to the vicinity of the joint surface of the developing frame or the toner frame exceeding the adhering seat surfaces for adhering the seal members are formed on the joint surface of the toner frame or the developing frame.

With this arrangement, the toner frame and the developing frame can be joined together without damaging the seal members. Further, the seal members can easily be positioned and attached to the toner frame or the developing frame. Accordingly, a process cartridge in which toner leakage through the opening due to damage to the seal member, or toner leakage through the area between the seal member adhering surfaces of the toner frame or the developing frame for securing the seal members and the seal members can be prevented, and an image forming apparatus to which such a process cartridge can detachably mounted are provided.

As mentioned above, according to the present invention, the toner frame and the developing frame can be joined together positively.

What is claimed is:

1. A method for joining a developing frame and a developing agent frame used in a process cartridge which can detachably be mounted to a main body of an electrophotographic image forming apparatus, said developing frame supporting a developing means for developing a latent image formed an electrophotographic photosensitive member and said developing agent frame having a developing agent containing portion for containing developing agent to be used in development effected by said developing means, wherein a long-side directional projection is formed on one of said developing frame and said developing agent frame at one short-side directional end thereof along a longitudinal direction thereof in order to be used for ultrasonic welding between said developing frame and said developing agent frame, a portion of said long-side directional projection being melted during the ultrasonic welding to weld said developing frame and said developing agent frame together, wherein a seal is provided for preventing the developing agent from leaking between said developing frame and said developing agent frame wherein an inclined surface is provided on a portion of said long-side directional projection which contacts said seal and is transverse to a longitudinal direction of said seal, said inclined surface being provided on a surface at the other end in the short-side direction of said frame on which said long-side directional projection is positioned, and being lowered toward said other end, the method comprising:

a seal attaching step for attaching said seal to one of said developing frame and said developing agent frame along a short-side direction thereof;

a frame abutting step for urging said developing frame and said developing agent frame against each other with the interposition of said seal between both frames; and a joining step for melting said long-side directional projection by applying vibration to it, thereby joining said developing frame and said developing agent frame together.

2. A method according to claim 1, wherein said frame not having said long-side directional projection is provided with an inclined surface mating with said inclined surface of said long-side directional projection when said developing frame and said developing agent frame are urged against each other, and, when said both frames are urged against each other, said inclined surfaces are opposed to each other with the interposition of said seal.

3. A method according to claim 1 or 2, wherein one of said developing frame and said developing agent frame is provided with a short-side directional projection along a short-side direction thereof, and, when said seal is attached, said seal is positioned along said short-side directional projection and adhered to said one frame.

4. A method according to claim 1, wherein a groove is provided along said long-side directional projection, and said groove serves to prevent a part of said long-side directional projection melted during the ultrasonic welding from escaping to the outside.

5. A process cartridge which can detachably be mounted to a main body of an electrophotographic image forming apparatus, comprising:

an electrophotographic photosensitive member;

developing means for developing a latent image formed on said electrophotographic photosensitive member;

a developing frame for supporting said developing means;

a developing agent frame having a developing agent containing portion for containing developing agent to be used in development effected by said developing means;

a long-side directional projection formed on one of said developing frame and said developing agent frame at one short-side end thereof along a longitudinal direction thereof to be used for ultrasonic welding between said developing frame and said developing agent frame, a portion of said long-side directional projection being melted during the ultrasonic welding;

a seal provided between said developing frame and said developing agent frame along a short-side direction of said developing frame and said developing agent frame and adapted to prevent the developing agent from leaking from the short-side direction of said both frames; and an inclined surface provided on a portion of said long-side directional projection which contacts said seal and is transverse to a longitudinal direction of said seal, said inclined surface being provided on a surface at the other end in the short-side direction of said frame on which said long-side directional projection is positioned, and being lowered toward said the other end.

6. A process cartridge according to claim 5, wherein said frame not having said long-side directional projection is provided with an inclined surface mating with said inclined surface of said long-side directional projection when said developing frame and said developing agent frame are urged against each other.

7. A process cartridge according to claim 5 or 6, wherein said one of said developing frame and said developing agent frame is provided with a short-side directional projection along a short-side direction thereof, and said short-side directional projection serves to position said seal when said seal is adhered between said developing frame and said developing agent frame.

8. A process cartridge according to claim 5, wherein a groove is provided along said long-side directional projection, and said groove serves to prevent a part of said long-side directional projection melted during the ultrasonic welding from escaping to the outside.

9. A process cartridge according to claim 5, further comprising at least one of a charge member for charging said electrophotographic photosensitive member and a cleaning member for removing residual developing agent remaining on said electrophotographic photosensitive member.

10. A developing frame used in a process cartridge which can detachably be mounted to a main body of an electrophotographic image forming apparatus, the process cartridge having an electrophotographic photosensitive member and a developing means for developing a latent image formed on said electrophotographic photosensitive member; said developing frame comprising:

(a) a developing means attaching portion for attaching said developing means;

(b) a long-side directional projection formed on a developing agent frame at one short-side end thereof along a longitudinal direction thereof to be used for ultrasonic welding to said developing agent frame, a portion of said long-side directional projection being melted during the ultrasonic welding to weld said developing frame and said developing agent frame together;

(c) a seal adhering portion to which a seals adhered, said seal serving to prevent the developing agent from leaking between said frames; and (d) an inclined surface provided on a portion of said long-side directional projection which contacts said seal and is transverse to a longitudinal direction of said seal, said inclined surface being provided on a surface at the other end in the short-side direction of said frame on which said long-side directional projection is positioned, and being lowered toward said other end.

11. A developing frame according to claim 10, further comprising a short-side directional projection provided along a short-side direction of said developing frame and serving to position said seal when said seal is adhered to said seal adhering portion.

12. A developing frame according to claim 10 or 11, wherein a groove is provided along said long-side directional projection, and serves to prevent a part of said long-side directional projection melted during the ultrasonic welding from escaping to the outside.

13. A process cartridge which can detachably be mounted to a main body of an electrophotographic image forming apparatus, comprising:

an electrophotographic photosensitive member;

developing means for developing a latent image formed on said electrophotographic photosensitive means;

a developing frame for supporting said developing means;

a developing agent frame having a developing agent containing portion for containing developing agent used in development effected by said developing means;

a seal provided between said developing frame and said developing agent frame along a short-side direction of said both frames and adapted to prevent the developing agent from leaking from the short-side direction of said both frames; and a short-side directional projection provided along a short-side direction of said developing frame, said seal being adhered along said short-side directional projection.

14. A process cartridge according to claim 13, further comprising at least one of a charge member for charging said electrophotographic photosensitive member and a cleaning member for removing residual developing agent remaining on said electrophotographic photosensitive member.

15. A developing frame used in a process cartridge which can detachably be mounted to a main body of an electrophotographic image forming apparatus, said process cartridge having an electrophotographic photosensitive member and a developing means for developing a latent image formed on said electrophotographic photosensitive member, said developing frame comprising:

(a) a developing means attaching portion for attaching said developing means;

(b) a seal adhering portion to which a seal is adhered to prevent the developing agent from leaking between said developing frame and said developing agent frame; and (c) a short-side directional projection provided along a short-side direction of said developing frame to position said seal when said seal is adhered.

16. A developing frame according to claim 10 or 15, wherein said seal is an elastic member.

* * * * *

UNITED STATES PATENT AND TRADEMARK OFFICE

CERTIFICATE OF CORRECTION

PATENT NO. : 5,974,288

DATED : October 26, 1999

INVENTOR(S) : MINORU SATO

It is certified that error appears in the above-identified patent and that said Letters Patent is hereby corrected as shown below:

COLUMN 4:

Line 63, "lad" should read --10d--.

COLUMN 13:

Line 19, "mounted" should read --be mounted--.

COLUMN 15:

Line 20, "seals" should read --seal--.

Signed and Sealed this

Twenty-fifth Day of July, 2000

*Attest:*

*Attesting Officer*

Q. TODD DICKINSON

*Director of Patents and Trademarks*